US011307521B2

(12) United States Patent
Kimura

(10) Patent No.: US 11,307,521 B2
(45) Date of Patent: Apr. 19, 2022

(54) IMAGE FORMING APPARATUS AND IMAGE FORMING METHOD

(71) Applicant: Konica Minolta, Inc., Tokyo (JP)

(72) Inventor: Kazuyoshi Kimura, Hachioji (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 17/328,416

(22) Filed: May 24, 2021

(65) Prior Publication Data

US 2021/0389702 A1 Dec. 16, 2021

(30) Foreign Application Priority Data

Jun. 11, 2020 (JP) ..... JP2020-101536

(51) Int. Cl.
*G03G 15/20* (2006.01)
*G03G 15/00* (2006.01)

(52) U.S. Cl.
CPC ..... *G03G 15/2039* (2013.01); *G03G 15/6585* (2013.01)

(58) Field of Classification Search
CPC ..... G03G 15/2039; G03G 15/6586
See application file for complete search history.

(56) References Cited

U.S. PATENT DOCUMENTS

2008/0135160 A1* 6/2008 Iwasaki ..... B32B 37/1207 156/60

FOREIGN PATENT DOCUMENTS

| | | |
|---|---|---|
| JP | 63-006585 | 1/1988 |
| JP | 04-178674 | 6/1992 |
| JP | 2006-350069 | 12/2006 |
| WO | WO-2021066999 A1 * | 4/2021 |

* cited by examiner

*Primary Examiner* — Clayton E. LaBalle
*Assistant Examiner* — Michael A Harrison
(74) *Attorney, Agent, or Firm* — BakerHostetler

(57) ABSTRACT

An image forming apparatus may include: a fixer that includes a fixing nip and makes an image formation medium pass through the fixing nip, to apply heat and pressure to the image formation medium, and fix toner containing wax to the image formation medium, an image formed with the toner having been transferred onto the image formation medium; and a hardware processor that controls the fixer in such a manner that an amount of wax precipitating on a surface of the image formation medium, when a laminating process is performed on the image formation medium to which the toner has been fixed, becomes smaller than when the laminating process is not performed.

18 Claims, 10 Drawing Sheets

IMAGE FORMING APPARATUS AND IMAGE FORMING METHOD

CROSS-REFERENCE TO RELATED APPLICATIONS

This application claims priority to Japanese patent application no. 2020-101536 filed on Jun. 11, 2020, the entire disclosure of which is incorporated herein by reference in its entirety.

BACKGROUND

Technological Field

The present disclosure relates to an image forming apparatus and an image forming method.

Description of the Related Art

These days, laminating processes are more often performed on printed materials on which images have been formed by an electrophotographic method. In a laminating process, a laminate film made of a resin such as polypropylene is thermally bonded to a surface of a printed material. The laminating process enhances the glossiness of the printed material, and protects the printed material. Examples of conventional image forming apparatuses that perform laminating processes include techniques disclosed in JP 4-178674 A, JP 2006-350069 A, and JP 63-6585 A.

In a print output device with a laminating function according to JP 4-178674 A, it is possible to select a temperature suitable for fixing a toner image, and a temperature suitable for laminating two thin plastic films to be welded to each other.

In an electrophotographic copying machine with a laminating function according to JP 2006-350069 A, a fixing unit rotates to switch to a mode for performing a laminating process.

In an electrophotographic copying machine with a laminating function according to JP 63-6585 A, only a conveyor device and a fixing device can be operated when a sheet-like printed material is laminated with a transparent synthetic resin film on which an adhesive layer is formed.

Meanwhile, image formation by an electrophotographic method uses toner containing wax. This wax dissolves from the toner due to the heat during the fixing, and precipitates on the surface of a paper sheet. This precipitated wax then cools down and solidifies on the surface of the paper sheet, giving the printed image glossiness.

Conventional techniques do not take into consideration the wax contained in any toner. For this reason, in the laminating process performed on a printed material by an electrophotographic method, there is a problem that the laminate film is lifted from the paper sheet due to the influence of the wax in the toner. Particularly, on a printed material having many solid portions in an image, the wax precipitating on the surface of the paper sheet may cause the laminate film to peel off from the paper sheet.

To prevent such peeling of a laminate film, there is a method of using an on-demand film. However, it is difficult to use the method, because such a film is not widely available and is expensive. A pouch that covers a paper sheet from both sides with a resin film that is larger than the paper sheet in size is different from a laminating process.

SUMMARY

An object of the present disclosure is to provide an image forming apparatus and an image forming method capable of preventing a laminated film from peeling away from a printed material formed with toner containing wax.

To achieve the abovementioned object, according to an aspect of the present disclosure, an image forming apparatus reflecting one aspect of the present disclosure comprises: a fixer that includes a fixing nip, and makes an image formation medium pass through the fixing nip, to apply heat and pressure to the image formation medium, and fix toner containing wax to the image formation medium, an image formed with the toner having been transferred onto the image formation medium; and a hardware processor that controls the fixer in such a manner that an amount of wax precipitating on a surface of the image formation medium when a laminating process is performed on the image formation medium to which the toner has been fixed becomes smaller than when the laminating process is not performed.

BRIEF DESCRIPTION OF THE DRAWINGS

The advantages and features provided by one or more embodiments of the disclosure will become more fully understood from the detailed description given hereinbelow and the appended drawings which are given by way of illustration only, and thus are not intended as a definition of the limits of the present disclosure.

DETAILED DESCRIPTION OF EMBODIMENTS

Figure 1:
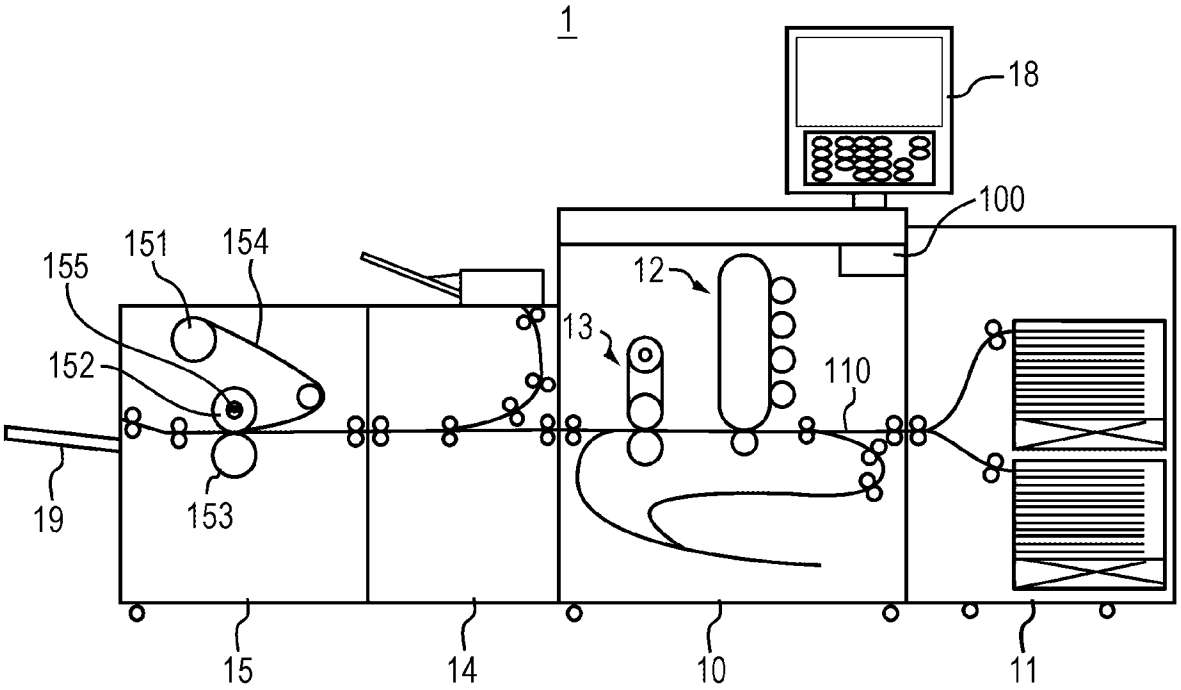
FIG. 1 is a schematic diagram showing the configuration of an image forming apparatus according to an embodiment of the present disclosure.

Hereinafter, one or more embodiments of the present disclosure will be described with reference to the drawings. However, the scope of the disclosure is not limited to the disclosed embodiments. In the description below with reference to the drawings, like components are denoted by like reference numerals, and explanation of those components will not be repeated twice or more. The dimensional ratios in the drawings are increased for ease of explanation, and may differ from the actual dimensional ratios.

FIG. 1 is a schematic diagram showing the configuration of an image forming apparatus according to an embodiment of the present disclosure.

An image forming apparatus 1 includes an image former 10, a sheet feeder 11, an inserter 14, and a laminator 15.

The image former 10 forms (prints) an image on a paper sheet by a conventional electrophotographic method. The image former 10 includes an image forming engine 12 and a fixer 13. The image former 10 is controlled by a controller 100, which will be described later, to perform printing in synchronization with the sheet conveyance timing and the conveyance speed.

The image forming engine 12 is of a tandem type. The image forming engine 12 includes a plurality of photosensitive drums and toner units (not shown) for the respective colors, though not described in detail herein because they are known components. The photosensitive drums and the toner units are for the respective colors of yellow (Y), magenta (M), cyan (C), and black (K).

The fixer 13 fixes a toner image that has been transferred onto a paper sheet, to the paper sheet at a predetermined fixing temperature and pressure. The fixer 13 is controlled by a controller 100.

The sheet feeder 11 stores paper sheets that are an image formation medium. The sheet feeder 11 supplies the paper sheets into a conveyance path 110 for conveying the paper sheets in the image forming apparatus 1. The conveyance path 110 has a plurality of rollers, and continues from the sheet feeder 11 to a sheet catch tray 19 via the image former 10, the inserter 14, and the laminator 15.

The inserter 14 inserts sheets into the conveyance path 110 on the downstream side of the image former 10, in addition to the paper sheets from the sheet feeder 11.

The laminator 15 performs a laminating process on a paper sheet subjected to printing. The laminator 15 includes a laminate film roller 151, an upper roller 152, and a lower roller 153.

A laminate film 154 is wound around the laminate film roller 151. The laminate film roller 151 sends out the laminate film 154 toward the upper roller 152.

The upper roller 152 has a halogen heater 155 as a heat source therein. The upper roller 152 is formed with a fluorine material coating the surface of an aluminum cored bar, for example The lower roller 153 applies pressure in the direction toward the upper roller 152. The lower roller 153 rotates in synchronization with rotation of the upper roller 152. The lower roller 153 is formed with a silicone rubber layer formed on the surface of an aluminum or stainless-steel cored bar, and a fluorine material coating the surface of the silicone rubber layer, for example.

The upper roller 152 and the lower roller 153 form a nip for lamination. The laminate film 154 is stacked on a paper sheet, and is conveyed to the nip for lamination. The paper sheet and the laminate film 154 passing through the nip for lamination are welded together by the heat from the halogen heater 155. The welded laminate film 154 is cut by a splitter (not shown) provided on the downstream side of the nip for lamination.

In a case where the laminating process is not to be performed, the supply of the laminate film 154 is stopped, and the upper roller 152 is driven to rotate in synchronization with conveyance of paper sheets. Alternatively, in a case where the position of the upper roller 152 is changeable, and the laminating process is not to be performed, the upper roller 152 may be retracted to a position at which the laminate film 154 is not to come into contact with the paper sheets.

Figure 2:
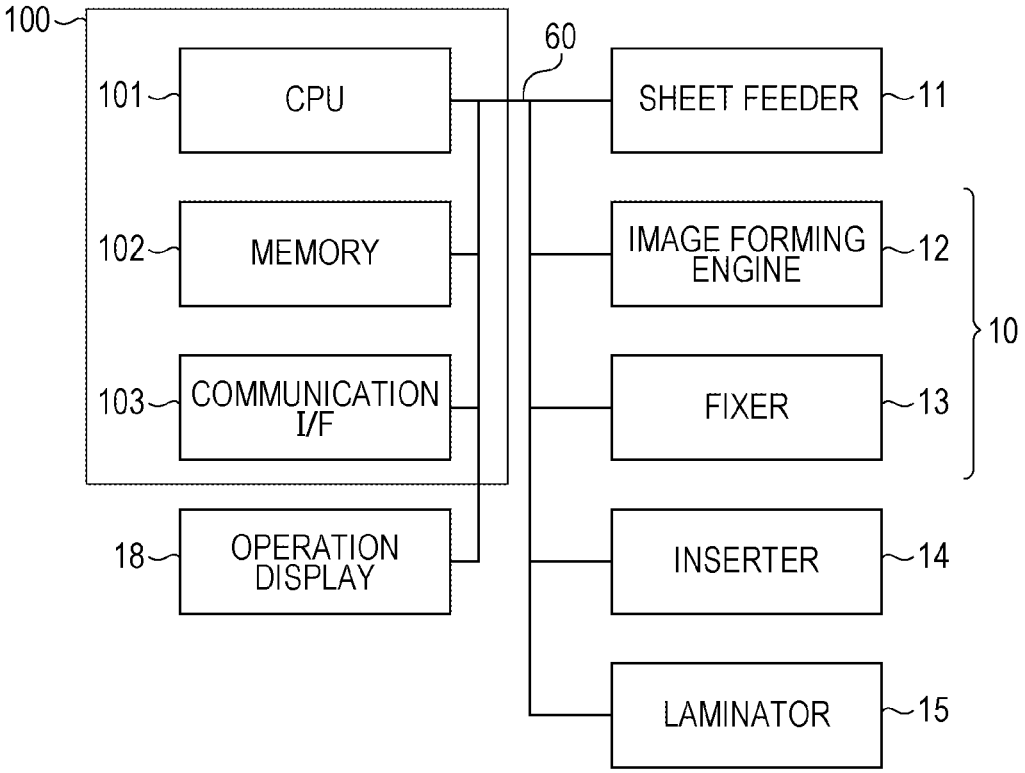
FIG. 2 is a block diagram showing the control system of the image forming apparatus.

FIG. 2 is a block diagram showing the control system of the image forming apparatus 1. The image forming apparatus 1 has the controller 100 in the image former 10. The controller 100 controls the respective components of the image forming apparatus 1. As shown in FIG. 2, the controller 100 and each component of the image forming apparatus 1 are connected by a signal line 60.

The controller 100 is a computer, and includes a CPU 101, a memory 102, a communication interface (I/F) 103, and the like. An operation display 18 is also connected to the controller 100.

The CPU 101 controls the respective components and performs various arithmetic processes, on the basis of various programs and various kinds of data.

The memory 102 includes a ROM that into which various programs and various kinds of data are stored beforehand, a RAM that serves as a work area for the CPU 101 to temporarily store programs and data, and a hard disk or the like that stores various programs and various kinds of data.

The communication interface 103 connects the image forming apparatus 1 and an external device by data communication. The external device is a computer, a mobile terminal, or the like, for example, and transmits print data to the image forming apparatus 1. The communication interface 103 may be a network interface compliant with standards such as SATA, PCI Express, USB, Ethernet (registered trademark), or IEEE 1394, a wireless communication interface such as Bluetooth (registered trademark) or IEEE 802.11, or the like, for example.

The operation display 18 includes a display with a touch screen, a numeric keypad, a start button, and a stop button. The operation display 18 displays the state of each component, image data, and the like. The operation display 18 is also used for inputting instructions from the user, such as various settings related to image formation.

Next, the fixer 13 is described. In this embodiment, a plurality of fixers 13 having different functions are described.

(First Fixer)

Figure 3:
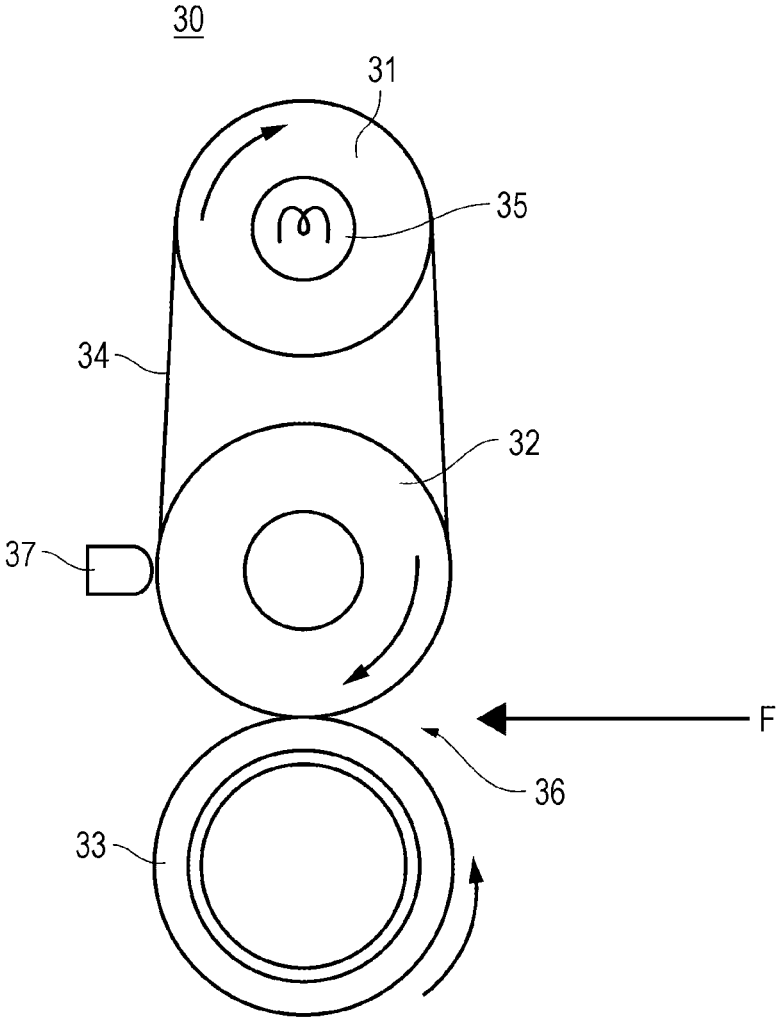
FIG. 3 is a schematic side view for explaining the configuration of a first fixer.

FIG. 3 is a schematic side view for explaining the configuration of a first fixer.

A first fixer 30 includes a heating roller 31, an upper pressure roller 32, a lower pressure roller 33, and a fixing belt 34. In the drawing, an arrow F indicates the direction of conveyance of paper sheets. The same applies in the other drawings.

The heating roller 31 has a halogen heater 35 as a heat source therein. The heating roller 31 is formed with a fluorine material coating the surface of an aluminum cored bar, for example The upper pressure roller 32 applies pressure to the fixing belt 34 in the direction toward a fixing nip 36. The upper pressure roller 32 is formed with a silicone rubber layer formed on the surface of an aluminum or stainless-steel cored bar, for example. The fixing nip 36 is formed with the portion of the fixing belt 34 pressed by the upper pressure roller 32, and the lower pressure roller 33.

The lower pressure roller 33 rotates in synchronization with rotation of the upper pressure roller 32. The lower pressure roller 33 is formed with a silicone rubber layer formed on the surface of an aluminum or stainless-steel cored bar, and a fluorine material coating the surface of the silicone rubber layer, for example. The lower pressure roller 33 applies pressure to the paper sheet passing through the fixing nip 36, in the direction toward the fixing belt 34. A driving force from a drive source is transmitted to the upper pressure roller 32 and the lower pressure roller 33, and the upper pressure roller 32 and the lower pressure roller 33 rotate in synchronization with each other. The heating roller 31 is driven to rotate by movement of the fixing belt 34, which moves with rotation of the upper pressure roller 32.

The fixing belt 34 is an endless belt that is in contact with the heating roller 31 and the upper pressure roller 32, and is stretched. The fixing belt 34 is formed with a silicone rubber layer formed on a polyimide base material, and a fluorine material further formed as a surface layer, for example. The fixing belt 34 is heated by the heating roller 31, and movement of the fixing belt 34 transfers heat to the fixing nip 36, to apply heat and pressure to the paper sheet being nipped and conveyed by the fixing nip 36. Thus, an unfixed toner image is fixed onto the paper sheet.

In the first fixer 30, a temperature sensor 37 that is in contact with the fixing belt 34 and measures temperature is also provided. As the temperature sensor 37 is disposed in the vicinity of the fixing nip 36, the temperature of the fixing nip 36 is measured. A signal from the temperature sensor 37 is transmitted to the controller 100. The temperature sensor 37 may be disposed at any position at which the temperature of the fixing nip 36 can be measured, and is not limited to a position on the downstream side of the fixing belt 34 in the moving direction. For example, the temperature sensor 37 may be disposed on the upstream side of the fixing nip 36 in the moving direction. Further, the temperature sensor 37 may be of a non-contact type.

The controller 100 controls outputs of the halogen heater, or the heating temperature at the time of fixing, on the basis of a signal from the temperature sensor 37.

Figure 4:
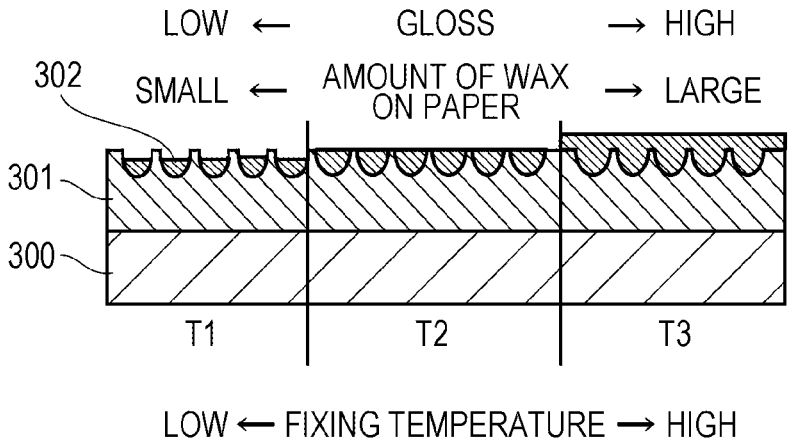
FIG. 4 is a schematic diagram for explaining the relationship between the fixing temperature and the amount of wax precipitating on the surface of a paper sheet.

The relationship between the fixing temperature and the amount of wax deposited on the surface of a paper sheet is now described. FIG. 4 is a schematic diagram (cross-sectional diagram) for explaining the relationship between the fixing temperature and the amount of wax precipitating on the surface of a paper sheet.

The fixer 13 fixes an image formed with toner 301 onto a paper sheet 300. In FIG. 4, three regions T1, T2, and T3 having different fixing temperatures in a fixing operation are shown. The temperatures in the respective regions have the relationship, T1<T2<T3.

In the region T1 with a low fixing temperature, the amount of wax 302 dissolving from the toner 301 is small. Therefore, in the region T1, the wax 302 hardly precipitates on the surface of the toner 301. The glossiness of the image is low.

In the region T2 with a higher fixing temperature than that in the region T1, the amount of wax 302 dissolving from the toner 301 is larger than that in the region T1. Therefore, in the region T1, the wax precipitates on the surface of the toner 301. The glossiness of the image is medium.

In the region T3 with the highest fixing temperature, the amount of wax 302 dissolving from the toner 301 is larger than those in the other regions. Therefore, in the region T3, the wax covers the surface of the toner 301. The glossiness of the image is high.

In the laminating process, a laminate film is attached to the surface of a paper sheet by heat, as is well known. However, on the surface of a paper sheet with a large amount of wax 302, a laminate film does not adhere to the surface of the paper sheet due to the wax 302, and the laminate film is separated from the paper sheet at the portion.

Therefore, in this embodiment, in a case where the laminating process is to be performed on a printed material after an image is printed, the amount of wax precipitating on the surface of a paper sheet is controlled to be small.

In the first fixer 30, the amount of wax precipitating on the surface of a paper sheet is controlled with the fixing temperature.

Figure 5:
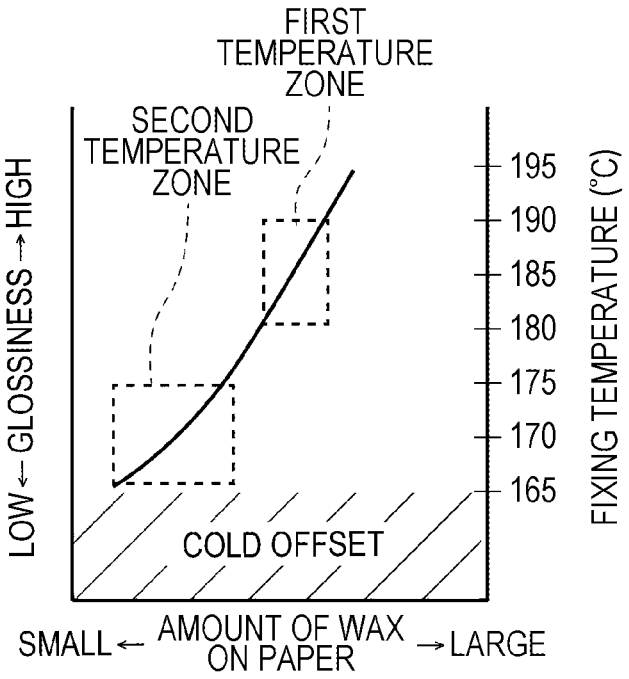
FIG. 5 is a graph showing the relationship between the fixing temperature, the amount of wax precipitating on the surface of a paper sheet, and the glossiness.

FIG. 5 is a graph showing the relationship between the fixing temperature, the amount of wax precipitating on the surface of a paper sheet, and the glossiness. In this embodiment, as shown in FIG. 5, the amount of wax precipitating on the surface of a paper sheet decreases as the fixing temperature drops. Meanwhile, the glossiness drops as the amount of wax precipitating on the surface of a paper sheet decreases.

In such a relationship, if the fixing temperature is made too low, toner will not be fixed onto paper sheets. Such poor fixing of toner is called "cold offset".

In view of the relationship shown in FIG. 5, in a case where the laminating process is not to be performed, the first fixer 30 performs fixing at a temperature in a first temperature zone as a normal operation. The first temperature zone is from 180° C. to 190° C., for example A toner image fixed at a temperature in this first temperature zone can achieve an appropriate glossiness.

In a case where the laminating process is to be performed, on the other hand, the first fixer 30 performs fixing, as a wax reducing operation, at a temperature in the second temperature zone, which is a temperature range that is at least 15° C. lower than the first temperature zone and does not cause cold offset. The second temperature zone is from 165° C. to 175° C., for example. A toner image fixed at a temperature in the first temperature zone can reduce the amount of wax precipitating on the surface of a paper sheet, and can prevent separation and peeling of the laminate film after the laminating process.

The amount and composition of the wax contained in toner varies depending on toner products. Therefore, the specific temperatures of the first temperature zone and the second temperature zone should be determined through experiments or the like taking into consideration the amount of wax precipitating on the sheet surface and the cold offset.

It is possible to control the amount of wax precipitating on the surface of a paper sheet not only by controlling the fixing temperature but also by controlling the sheet conveyance speed. The sheet conveyance speed is also called the process linear speed.

In a case where the laminating process is not to be performed, a first conveyance speed is adopted in a normal operation at the first fixer 30. In a case where the laminating process is to be performed, on the other hand, a second conveyance speed that is higher than the first conveyance speed is adopted in a wax reducing operation at the first fixer 30. The amount of wax precipitating on the surface of a paper sheet decreases as the conveyance speed drops. This is because, when the conveyance speed is high, the amount of heat applied to the paper sheet passing through the fixing nip 36 is small.

In a case where the first conveyance speed is set as the reference speed, for example, the second conveyance speed is twice higher than the first conveyance speed. If the conveyance speed is made too high, cold offset will occur as in a case where the fixing temperature is changed. Therefore, specific conveyance speeds should be determined through experiments or the like taking into consideration the amount of wax precipitating on the sheet surface and the cold offset.

Further, the amount of wax precipitating on the surface of a paper sheet may be controlled with both the fixing temperature and the conveyance speed.

(Second Fixer)

Figure 6:
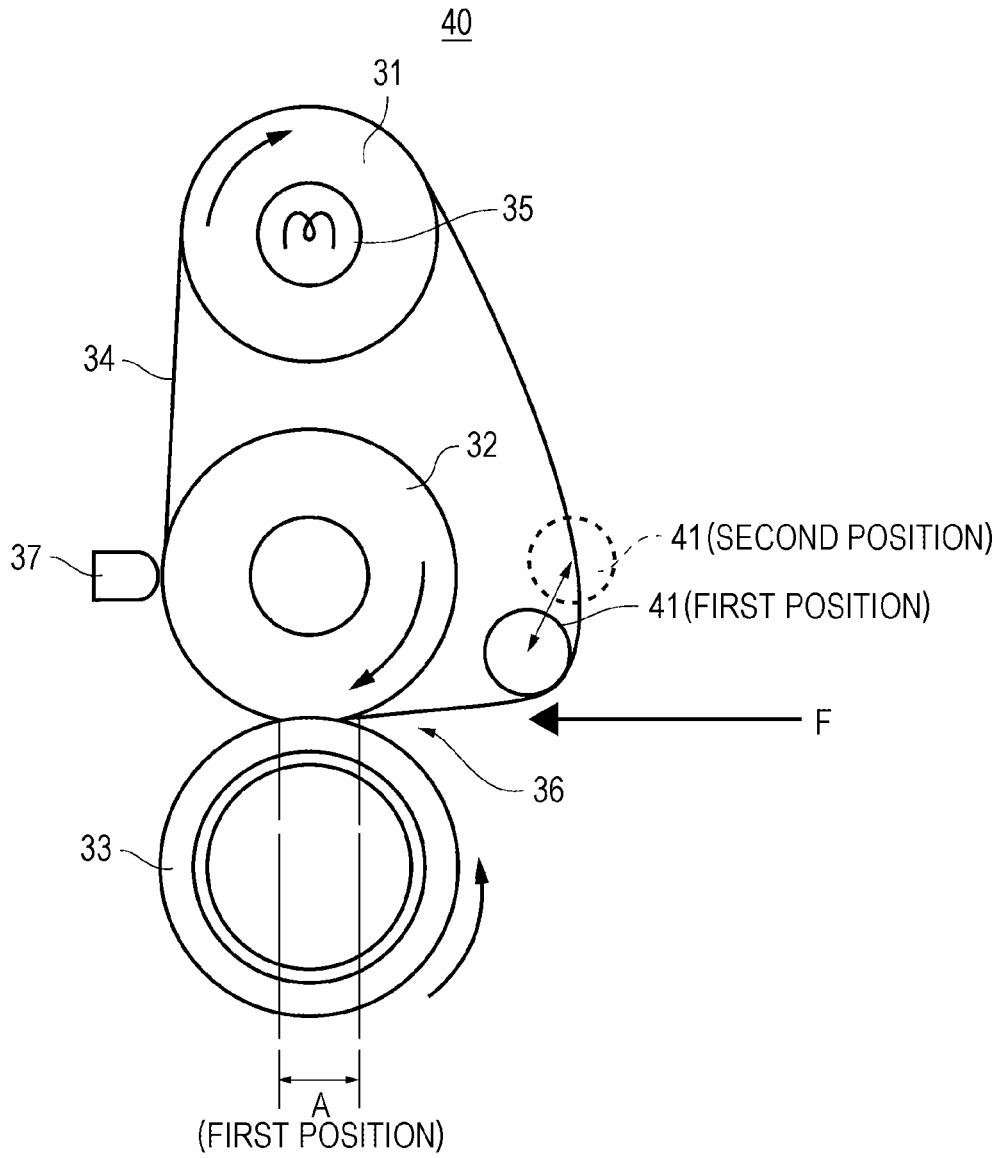
FIG. 6 is a schematic side view for explaining the configuration of a second fixer.
Figure 7:
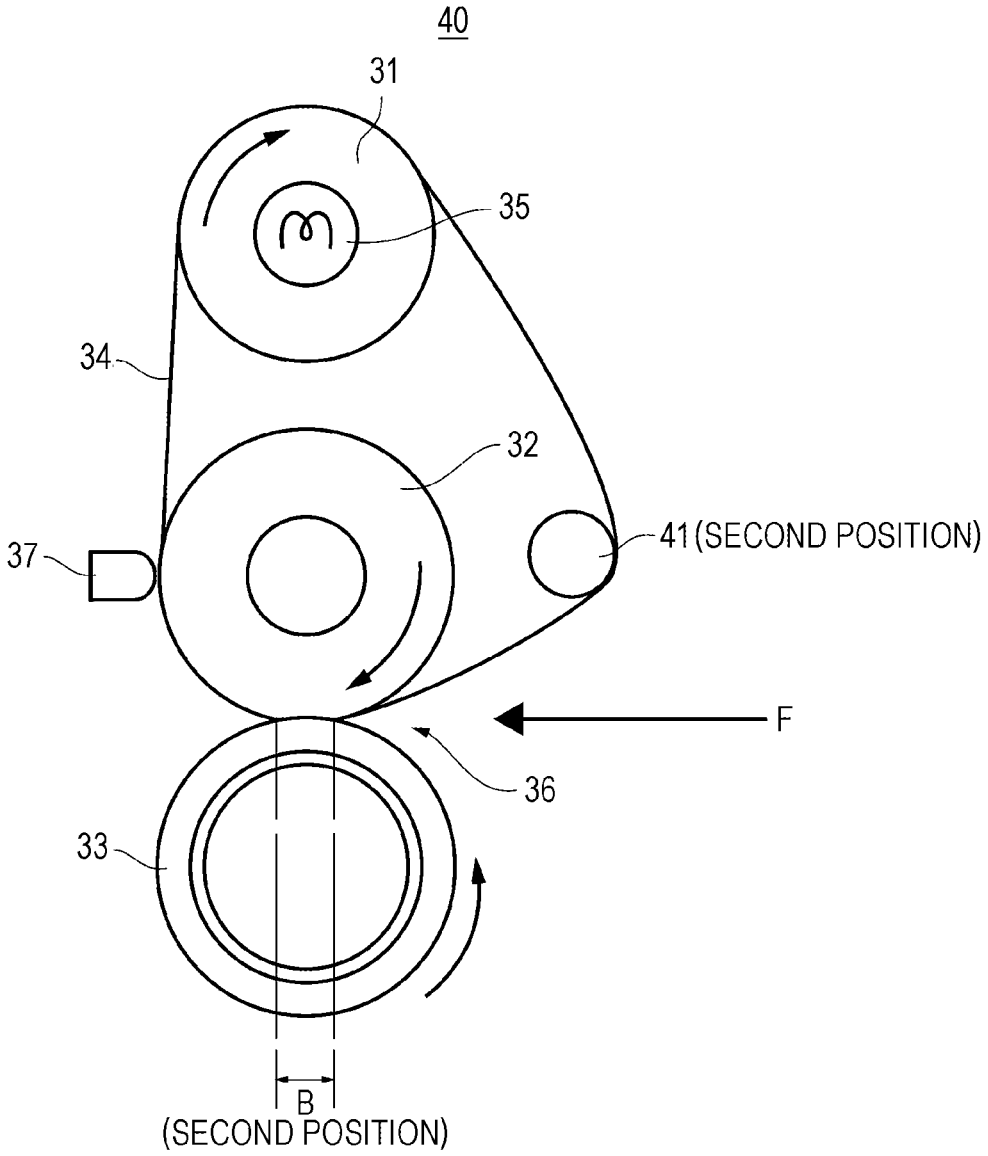
FIG. 7 is a schematic side view for explaining the configuration of the second fixer.

FIGS. 6 and 7 are schematic side views for explaining the configuration of a second fixer.

A second fixer 40 includes a heating roller 31, an upper pressure roller 32, a lower pressure roller 33, and a fixing belt 34, like the first fixer 30.

The second fixer 40 further includes an auxiliary roller 41 for changing the position of the fixing belt 34. As shown in FIG. 6, the auxiliary roller 41 can move to a first position (the position of the auxiliary roller indicated by a solid line), a second position (the position of the auxiliary roller indicated by a dashed line), or a position in between, as if to move along the outer circumference of the upper pressure roller 32. With this arrangement, at the second fixer 40, the width of the fixing nip 36 can be changed without any change in the tension of the fixing belt 34.

The width of the fixing nip 36 in a case where the auxiliary roller 41 is in the first position is represented by A (see FIG. 6). The width of the fixing nip 36 in a case where the auxiliary roller 41 is in the second position is represented by B (see FIG. 7). The relationship between the widths of the fixing nip 36 is expressed as A>B.

In a case where the laminating process is not to be performed, the second fixer 40 sets the auxiliary roller 41 in the first position in a normal operation (see the solid line in FIG. 6). In a case where the laminating process is to be performed, on the other hand, the second fixer 40 sets the auxiliary roller 41 in the second position in a wax reducing operation (see FIG. 7).

Accordingly, in a case where the laminating process is to be performed, the second fixer 40 can reduce the width of the fixing nip 36, to make the amount of heat to be applied to a paper sheet smaller than that in a case where the laminating process is not to be performed. Thus, the amount of wax precipitating on the surface of a paper sheet can be reduced.

If the width of the fixing nip 36 is made too small, cold offset will occur as in a case where the fixing temperature is changed. Therefore, specific widths of the fixing nip 36 should be determined through experiments or the like taking into consideration the amount of wax precipitating on the sheet surface and the cold offset.

(Third Fixer)

Figure 8:
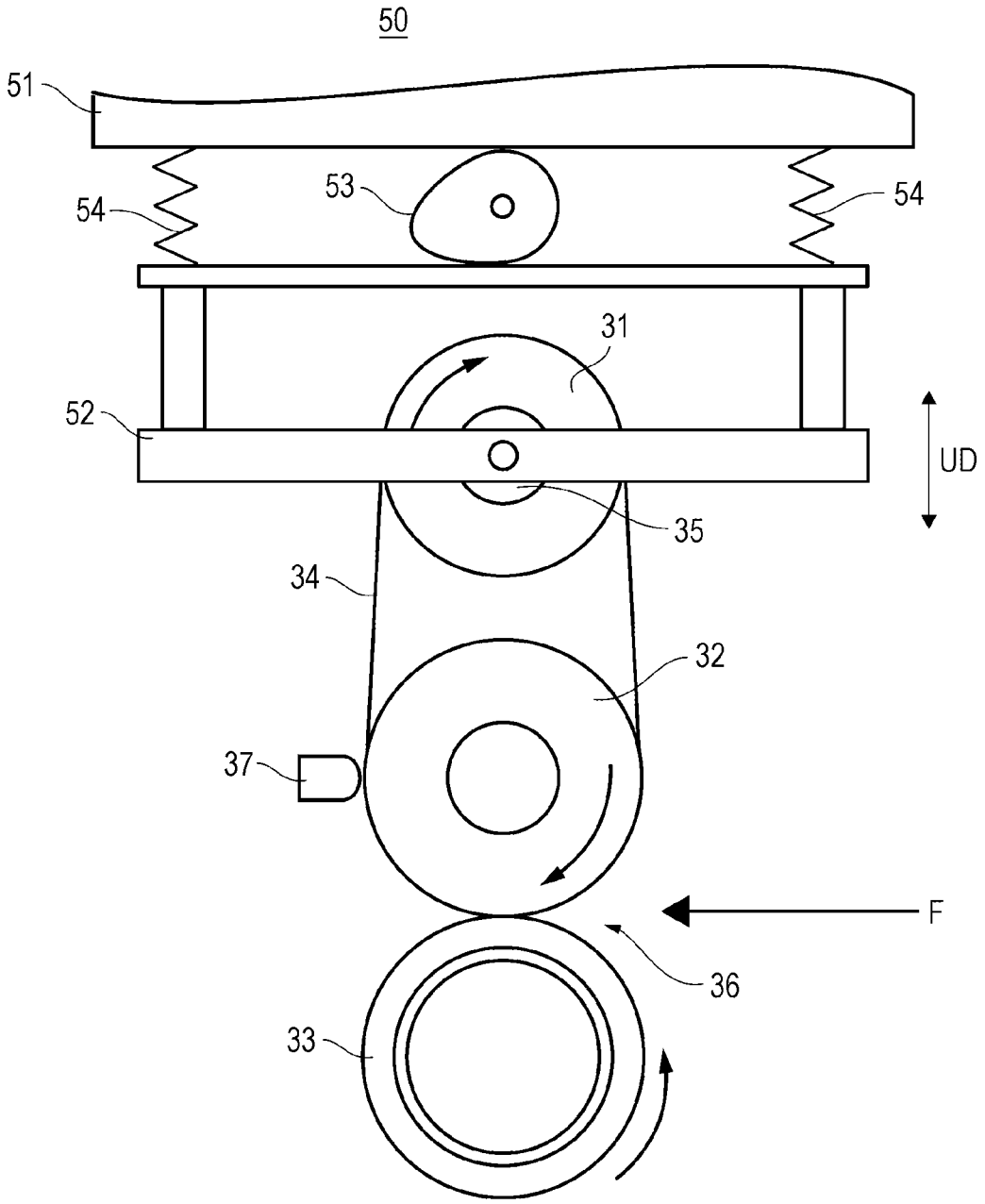
FIG. 8 is a schematic side view for explaining the configuration of a third fixer.

FIG. 8 is a schematic side view for explaining the configuration of a third fixer 50.

The third fixer 50 includes a heating roller 31, an upper pressure roller 32, a lower pressure roller 33, and a fixing belt 34, like the first fixer 30.

The third fixer 50 can change the position of the heating roller 31. Therefore, the third fixer 50 supports the heating roller 31 with a movable frame 52. The movable frame 52 is connected to a stationary frame 51 by a cam 53 and springs 54. As the cam 53 rotates, the movable frame 52 moves up and down as indicated by arrows UD in the drawing.

In the third fixer 50, when the movable frame 52 is lowered, the tension of the fixing belt 34 becomes lower. In the third fixer 50, when the tension of the fixing belt 34 becomes lower, the force for pulling up the upper pressure roller 32 becomes weaker. In the third fixer 50, the force for pulling up the upper pressure roller 32 becomes weaker, so that the pressure to be applied to the fixing nip 36 becomes lower.

Further, in the third fixer 50, when the movable frame 52 is raised, the tension of the fixing belt 34 becomes higher, and the force for pulling up the upper pressure roller 32 becomes greater. In the third fixer 50, the force for pulling up the upper pressure roller 32 becomes greater, so that the pressure to be applied to the fixing nip 36 becomes higher.

As described above, in the third fixer 50, it is possible to change the pressure on the fixing nip 36 by changing the tension of the fixing belt 34.

Therefore, in a case where the laminating process is not to be performed, in a normal operation at the third fixer 50, the position of the heating roller 31 is set to a first position, and the tension of the fixing belt 34 is set to a first tension.

In a case where the laminating process is to be performed, in a wax reducing operation at the third fixer 50, the position of the heating roller 31 is set to a second position raised from the first position, and the tension of the fixing belt 34 is set to a second tension. The relationship between the tensions of the fixing belt 34 is expressed as: first tension<second tension.

In a case where the laminating process is to be performed at the third fixer 50, with this second tension, the pressure on the fixing nip 36 is lowered, and the amount of heat to be applied to a paper sheet is made smaller than that in a case where the laminating process is not to be performed. With this arrangement, the amount of wax precipitating on the surface of a paper sheet in a case where the laminating process to be performed can be reduced at the third fixer 50.

Thus, the third fixer 50 can prevent separation and peeling of the laminate film after the laminating process.

If the pressure on the fixing nip 36 is made too low, cold offset will occur as in a case where the fixing temperature is changed. Therefore, specific pressures on the fixing nip 36 should be determined through experiments or the like taking into consideration the amount of wax precipitating on the sheet surface and the cold offset.

Although the position of the heating roller 31 is changed so that the pressure to be applied to the fixing nip 36 changes in this example, the position of the upper pressure roller 32 or the lower pressure roller 33 may be changed so that the pressure to be applied to the fixing nip 36 changes.

(Other Forms of the Fixer 13)

Further, other forms of fixers are described. The fixer described below includes a separator for separating a paper sheet from the fixing belt 34 during the laminating process. In the description below, the first fixer 30 is described as an example. However, the components other than the separator are not limited to the components of the first fixer 30, and may be those of the second fixer 40 or the third fixer 50. Therefore, the separator described below can also be provided in the second fixer 40 or in the third fixer 50.

The reason for providing the separator is as follows. Wax affects not only glossiness but also separability between the fixing belt 34 and a paper sheet. If the amount of wax precipitating on the surface of a paper sheet is small, the separability between the fixing belt 34 and the paper sheet deteriorates. The separator separates a paper sheet from the fixing belt 34 in a case where the separability between the fixing belt 34 and the paper sheet is poor.

Figure 9:
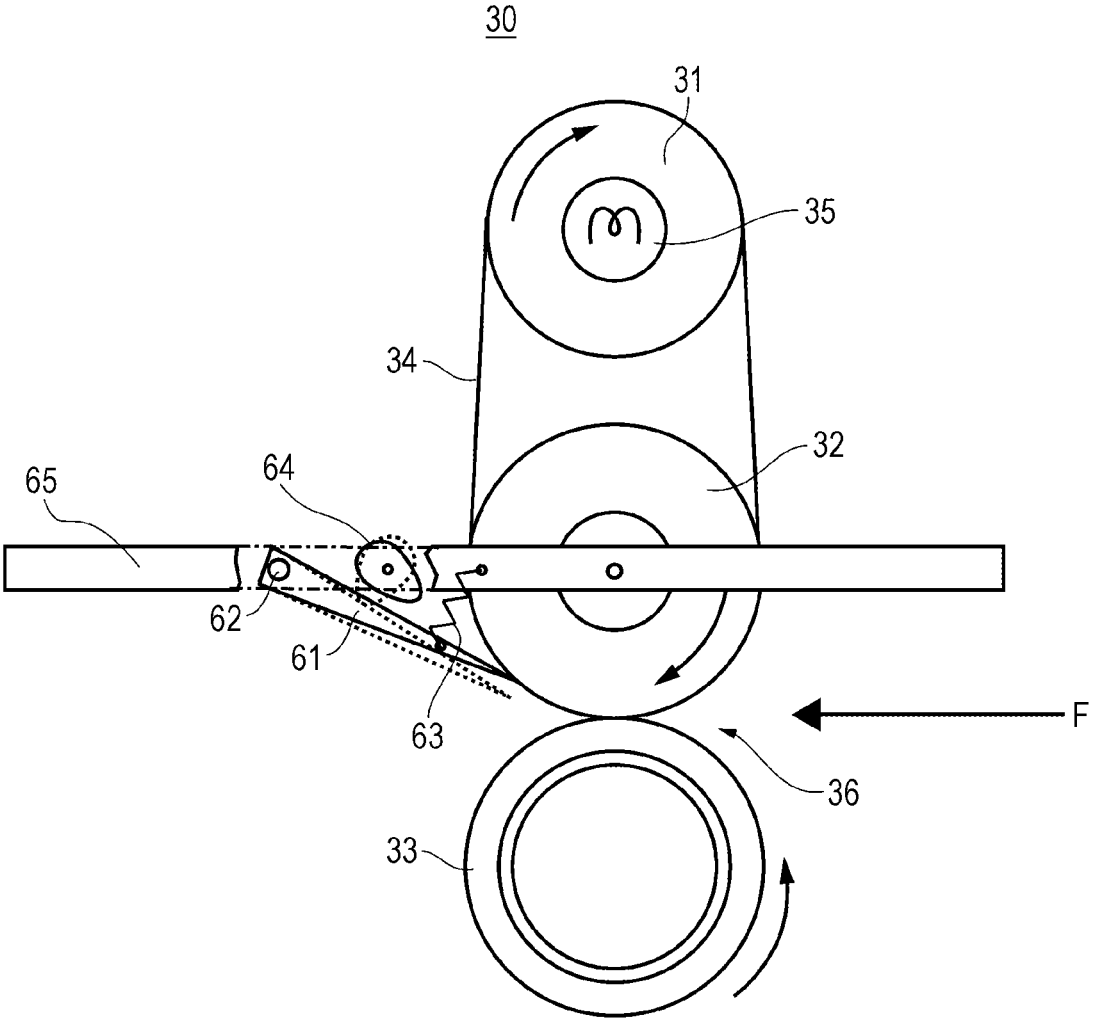
FIG. 9 is a schematic side view for explaining an example of a separator.

FIG. 9 is a schematic side view for explaining an example of a separator. The separator shown in FIG. 9 is a separation claw 61. The separation claw 61 is located on the downstream side of the fixing nip 36 in the sheet conveyance direction, and can be brought into contact with and be separated from the fixing belt 34. The "downstream" side in the sheet conveyance direction means the direction in which paper sheets are to be conveyed.

The separation claw 61 is rotatably supported by a shaft 62 attached to a frame 65. In FIG. 9, part of the frame 65 is cut off so that the inside can be seen. A spring 63 connected to the frame 65 is attached to the separation claw 61. The spring 63 pulls the tip of the separation claw 61 toward the fixing belt 34. The separation claw 61 rotationally moves with rotation of a cam 64.

When the cam 64 is located at a rotation position indicated by a solid line in FIG. 9, the cam 64 is away from the separation claw 61. In this state, the separation claw 61 is pulled by the spring 63, and its tip comes into contact with the fixing belt 34. When the cam 64 is located at a rotation position indicated by a dashed line in FIG. 9, on the other hand, the cam 64 comes into contact with the separation claw 61. In this state, the tip of the separation claw 61 is separated from the fixing belt 34 by the size of the cam 64.

In a case where the laminating process is to be performed, the separation claw 61 is brought into contact with the fixing belt 34, and separates the paper sheet from the fixing belt 34. In a case where the laminating process is not to be performed, on the other hand, the separation claw 61 is separated from the fixing belt 34.

Figure 10:
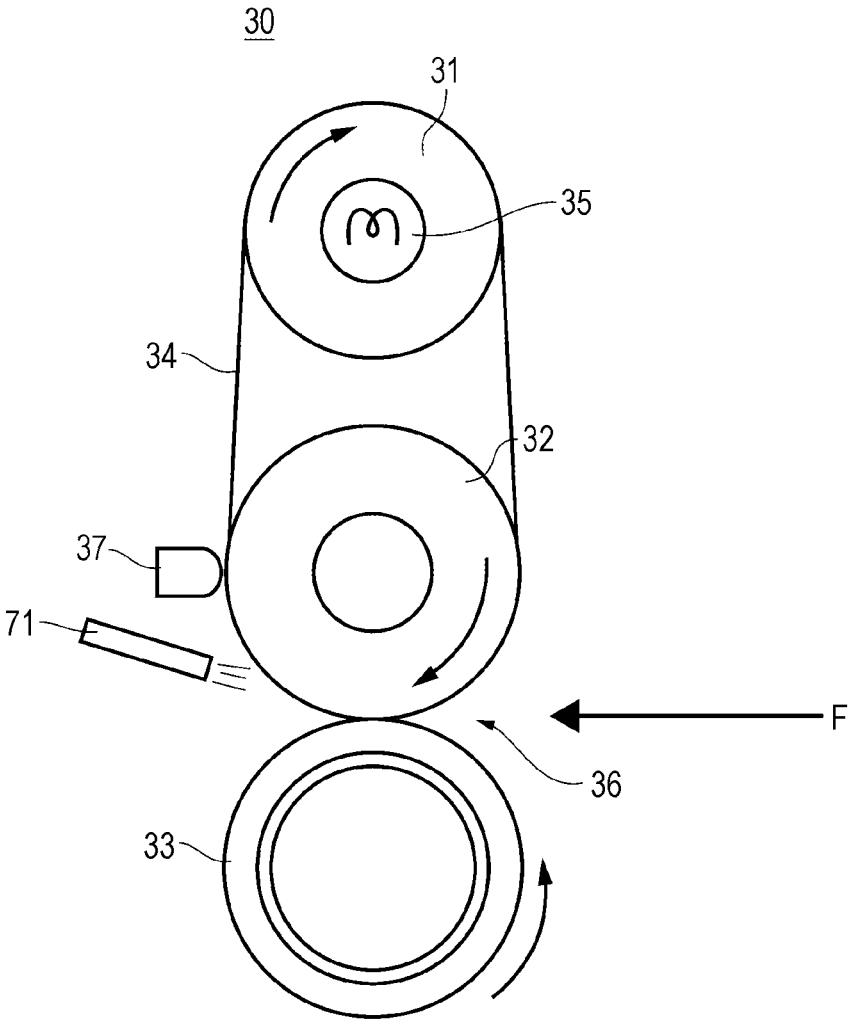
FIG. 10 is a schematic side view for explaining another example of a separator.

FIG. 10 is a schematic side view for explaining another example of a separator. The separator shown in FIG. 10 is an air nozzle 71. The air nozzle 71 is located on the downstream side of the fixing nip 36 in the sheet conveyance direction, and is disposed at a position where air is to be injected toward the fixing nip 36.

In a case where the laminating process is to be performed, air is injected from the air nozzle 71 toward the fixing nip 36. The paper sheet is separated from the fixing belt 34 by the injection of air. In a case where the laminating process is not to be performed, on the other hand, the injection of air from the air nozzle 71 is stopped.

Figure 11:
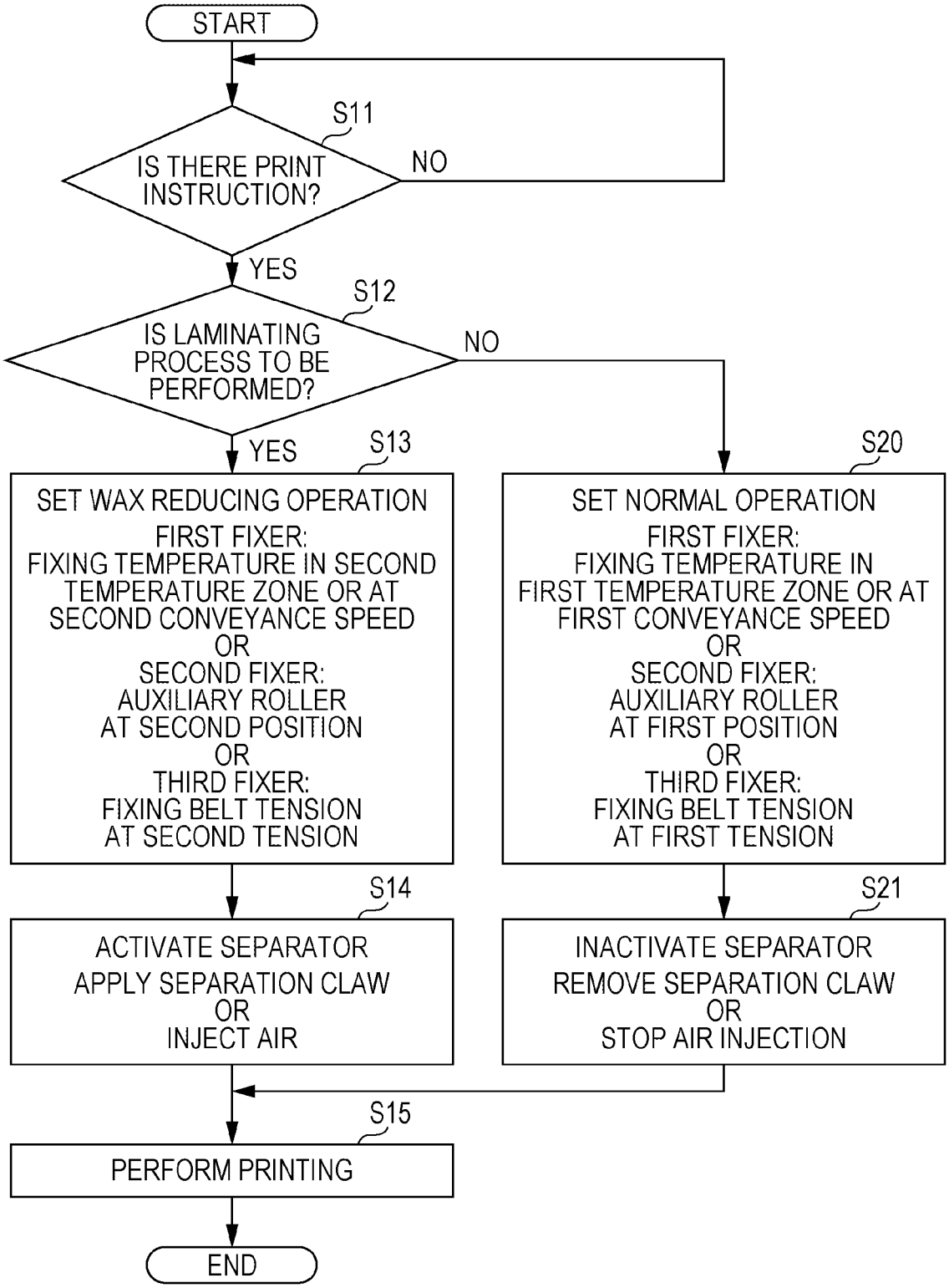
FIG. 11 is a flowchart showing the processing procedures in an image forming method.

Next, the processing procedures in an image forming method according to this embodiment are described. FIG. 11 is a flowchart showing the processing procedures in the image forming method.

The processing procedures are carried out by the controller 100.

The controller 100 first determines whether there is an input of a print instruction (S11). A print instruction is input from the operation display 18, for example. Alternatively, a print instruction is input as a print job from an external device, for example. In a case where the laminating process is to be performed, an instruction to that effect is also input when a print instruction is input from the operation display 18. Further, when a print job is input, an instruction indicating execution of the laminating process is described as a job ticket.

If it is determined in step S11 that there is not an input of a print instruction (S11: NO), the controller 100 waits for an input of a print instruction.

If it is determined in step S11 that a print instruction has been input (S11: YES), the controller 100 determines whether the laminating process is to be performed after printing (S12).

If it is determined in step S12 that the laminating process is not to be performed (S12: NO), the controller 100 sets a normal operation in the fixer 13 (S20). As described above, the setting of a normal operation varies depending on the form of the fixer 13. That is, in the first fixer 30, a fixing temperature in the first temperature zone, or the first conveyance speed is set. In the second fixer 40, the auxiliary roller 41 is set at the first position (fixing nip width A). In the third fixer 50, the tension of the fixing belt 34 is set at the first tension.

The controller 100 then makes the separator inactive (S21). To make the separator inactive, the separator is separated from the fixing belt 34 in the case of the separation claw 61, and injection of air is stopped in the case of air. After being activated in step S14, which will be described later, the separator may be returned to an inactive state after the end of a printing process. In this case, step S21 may be skipped.

After that, the controller 100 performs printing (S15), and ends the process.

If it is determined in step S12 that the laminating process is to be performed after printing (S12: YES), on the other hand, the controller 100 sets a wax reducing operation in the fixer 13 (S13). As described above, the setting of a wax reducing operation varies depending on the form of the fixer 13. That is, in the first fixer 30, a fixing temperature in the second temperature zone, or the second conveyance speed is set. In the second fixer 40, the auxiliary roller 41 is set at the second position (fixing nip width B). In the third fixer 50, the tension of the fixing belt 34 is set at the second tension.

The controller 100 then makes the separator active (S14). As described above, to make the separator active, the separator is brought into contact with the fixing belt 34 in the case of the separation claw 61, and air is injected in the case of air.

After that, the controller 100 performs printing (S15). In this embodiment, the laminating process can be performed on a printed material in an in-line manner, and therefore, printing is followed by the laminating process. After the printing and the laminating process are completed, the controller 100 ends the process.

According to this embodiment described above, the following effects are achieved.

In this embodiment, the fixing temperature is lowered to the limit of occurrence of cold offset, so that the amount of wax dissolving from the toner and precipitating on the surface of a paper sheet can be reduced. As a result, the toner layer is exposed more on the surface of the paper sheet, and it is possible to prevent the adhesive of the laminate film from causing defective adhesion due to wax.

A laminated paper sheet has a surface protection function as well as gloss from the laminate film. Accordingly, a sufficient glossiness can be achieved, even though the amount of wax precipitating on the surface of a paper sheet is reduced. The adhesive force between a paper sheet and toner should be such that fixing defects due to cold offset or the like do not occur during conveyance after image formation, and quality problems such as stains on the paper sheet do not occur.

Further, in this embodiment, not only the fixing temperature but also the sheet conveyance speed, the width of the fixing nip 36, the pressure on the fixing nip 36, and the like are changed, so that the amount of heat to be applied to a paper sheet is changed, and the amount of wax precipitating on the surface of the paper sheet is controlled. Thus, in this embodiment, the amount of wax can be controlled at the fixer 13 of various forms.

Also, in this embodiment, a separator for separating a paper sheet from the fixing belt 34 is provided. Thus, in this embodiment, even if the amount of wax precipitating on the surface of a paper sheet is reduced, the paper sheet can be separated from the fixing belt 34 without fail, and the occurrence of paper jams and the like can be reduced.

Although an embodiment has been described above, the present disclosure is not limited to the above embodiment.

In the above embodiment, a configuration in which the fixing belt 34 is used as the fixer 13 has been described, but the fixing nip 36 can be formed with a pair of upper and lower fixing rollers, without the use of the fixing belt 34, and heat and pressure can be applied thereto.

Also, in the above embodiment, the fixing temperature, the conveyance speed, the width of the fixing nip 36, or the pressure on the fixing nip 36 is changed. However, these may be combined in various manners, to control the amount of wax.

Further, in the above embodiment, the image forming apparatus 1 capable of performing the laminating process in an in-line manner after printing performed by the image former 10 has been described as an example. However, the laminating process may be performed by a different apparatus from the apparatus that forms a printed material. That is, an image forming apparatus to which the present disclosure is applied may not include the in-line laminator 15.

Further, the image formation medium may not be paper sheets. For example, the image formation medium is not limited to any particular one, and may be a cloth or a resin film on which an image can be formed by an electrophotographic method and the laminating process can be performed.

The conditions and numerical values in the description of the embodiment are used for ease of explanation, and the present disclosure is not limited to these conditions and numerical values.

The present disclosure can be modified in various manners on the basis of the configurations disclosed in the claims, and these are also within the scope of the present disclosure.

Although embodiments of the present disclosure have been described and illustrated in detail, the disclosed embodiments are made for purposes of illustration and example only and not limitation. The scope of the present disclosure should be interpreted by terms of the appended claims.

As used herein, the words "can" and "may" are used in a permissive (i.e., meaning having the potential to), rather than mandatory sense (i.e., meaning must). The words "include," "includes," "including," and the like mean including, but not limited to. Similarly, the singular form of "a" and "the" include plural references unless the context clearly dictates otherwise. And the term "number" shall mean one or an integer greater than one (i.e., a plurality).

What is claimed is:

1. An image forming apparatus, comprising:

a fixer that includes a fixing nip and makes an image formation medium pass through the fixing nip, to apply heat and pressure to the image formation medium, and fix toner containing wax to the image formation medium, an image formed with the toner having been transferred onto the image formation medium; and a hardware processor that controls the fixer in such a manner that an amount of wax precipitating on a surface of the image formation medium, when a laminating process is performed on the image formation medium to which the toner has been fixed, becomes smaller than when the laminating process is not performed.

2. The image forming apparatus according to claim 1, wherein, when the laminating process is performed, the hardware processor makes a temperature of the fixing nip lower than when the laminating process is not performed.

3. The image forming apparatus according to claim 2, further comprising:

a temperature sensor that measures the temperature of the fixing nip, wherein the hardware processor controls a temperature of the fixer in such a manner that the temperature measured by the temperature sensor falls within a temperature range from a temperature at least 15° C. lower than a temperature when the laminating process is not performed, to a temperature that does not cause cold offset.

4. The image forming apparatus according to claim 1, wherein, when the laminating process is performed, the hardware processor makes a width of the fixing nip smaller than when the laminating process is not performed.

5. The image forming apparatus according to claim 1, wherein, when the laminating process is performed, the hardware processor makes a pressure on the fixing nip lower than when the laminating process is not performed.

6. The image forming apparatus according to claim 1, wherein, when the laminating process is performed, the hardware processor makes a speed of conveyance of the image formation medium passing through the fixing nip higher than when the laminating process is not performed.

7. The image forming apparatus according to claim 1, wherein the fixer includes:

one of a fixing belt and a fixing roller that apply heat and pressure to the image formation medium; and a separator that separates the image formation medium from the one of the fixing belt and the fixing roller, when the laminating process is performed.

8. The image forming apparatus according to claim 7, wherein the separator is a separation claw that can be brought into contact with and be separated from the one of the fixing belt and the fixing roller, and wherein the hardware processor brings the separation claw into contact with the one of the fixing belt and the fixing roller, when the laminating process is performed.

9. The image forming apparatus according to claim 7, wherein the separator is an air nozzle that injects air toward the fixing nip from a downstream side of the fixing nip in a direction of conveyance of the image formation medium, and wherein the hardware processor causes the air nozzle to inject air, when the laminating process is performed.

10. An image forming method, comprising:

transferring an image formed with toner containing wax, onto an image formation medium; and fixing the toner to the image formation medium by applying heat and pressure to the image formation medium passing through a fixing nip, the image formed with the toner having been transferred onto the image formation medium, wherein, in the fixing, when a laminating process is performed on the image formation medium to which the toner has been fixed, control is performed in such a manner that an amount of wax precipitating on a surface of the image formation medium becomes smaller than when the laminating process is not performed.

11. The image forming method according to claim 10, wherein, in the fixing, when the laminating process is performed, a temperature of the fixing nip is made lower than when the laminating process is not performed.

12. The image forming method according to claim 11, wherein the fixing includes measuring the temperature of the fixing nip, and wherein, when the laminating process is performed, the temperature of the fixing nip is controlled in such a manner that the measured temperature falls within a temperature range from a temperature at least 15° C. lower than a temperature when the laminating process is not performed, to a temperature that does not cause cold offset.

13. The image forming method according to claim 10, wherein, in the fixing, when the laminating process is performed, a width of the fixing nip is made smaller than when the laminating process is not performed.

14. The image forming method according to claim 10, wherein, in the fixing, when the laminating process is performed, a pressure on the fixing nip is made lower than when the laminating process is not performed.

15. The image forming method according to claim 10, wherein, in the fixing, when the laminating process is performed, a speed of conveyance of the image formation medium passing through the fixing nip is made higher than when the laminating process is not performed.

16. The image forming method according to claim 10, wherein the fixing is performed by a fixer that includes one of a fixing belt and a fixing roller for applying heat and pressure to the image formation medium, the image forming method further comprising separating the image formation medium from the one of the fixing belt and the fixing roller, when the laminating process is performed.

17. The image forming method according to claim 16, wherein, in the separating, a separation claw that can be brought into contact with and be separated from the one of the fixing belt and the fixing roller is brought into contact with the one of the fixing belt and the fixing roller.

18. The image forming method according to claim 16, wherein, in the separating, air is injected toward the fixing nip from a downstream side of the fixing nip in a direction of conveyance of the image formation medium.

* * * * *